E2-92 5F
10/15/85 OR 4,546,579

United States Patent [19]

Rionda et al.

[11] Patent Number: 4,546,579

[45] Date of Patent: Oct. 15, 1985

[54] SEAT PLATE PROTECTING STRUCTURAL MEMBERS

[75] Inventors: Carlos S. Rionda; Joaquin J. Palacio, both of Miami, Fla.

[73] Assignee: Gang-Nail Systems, Inc., Miami, Fla.

[21] Appl. No.: 466,531

[22] Filed: Feb. 15, 1983

[51] Int. Cl.[4] ..... E04B 7/02

[52] U.S. Cl. ..... 52/92; 52/712; 52/DIG. 6; 411/466

[58] Field of Search ..... 52/92, 93, 712, 715, 52/DIG. 6, DIG. 6.6; 411/466–468

[56] References Cited

U.S. PATENT DOCUMENTS

| | | | |
|---|---|---|---|
| 2,101,378 | 12/1937 | Wiskoff | 52/DIG. 6 |
| 3,363,372 | 1/1968 | Raynes | 52/93 |
| 3,365,222 | 1/1968 | Polyak | 52/712 |
| 3,683,738 | 8/1972 | Kyriakos | 411/466 |
| 4,081,940 | 4/1978 | Hughes | 52/712 |
| 4,229,915 | 10/1980 | Snow et al. | 52/92 |

FOREIGN PATENT DOCUMENTS

| | | | |
|---|---|---|---|
| 26397 | 4/1981 | European Pat. Off. | 52/712 |

*Primary Examiner*—Carl D. Friedman
*Assistant Examiner*—N. N. Slack
*Attorney, Agent, or Firm*—LeBlanc, Nolan, Shur & Nies

[57] ABSTRACT

A seat plate for protecting wooden structural members against structural damage due to crushing, as well as the effects of moisture, humidity and the like. The plate member includes a pair of mutually perpendicular planar members and, in one embodiment, is in the form of a flat sheet metal plate which is bent along a fold line to provide first and second planar plate portions intersecting each other at right angles. One of the plate portions has a dimension in a direction perpendicular to the fold line which is substantially greater than the dimension of the other plate portion in a direction perpendicular to the fold line. The smaller of the two plate portions has a plurality of teeth struck therein to provide a means of attaching the seat plate member to the wooden structural member. In use, the seat plate may be installed with the smaller plate portion contiguous with a vertical side wall of the structural member, and with the larger plate portion contiguous with a lower horizontal surface of the structural member.

6 Claims, 4 Drawing Figures

SEAT PLATE PROTECTING STRUCTURAL MEMBERS

BACKGROUND OF THE INVENTION

The present invention relates to protective plate members for use with wooden structural components and, more particularly, to a seat plate joined to the outer end portion of a building structural member to provide protection against crushing of the structural member as well as against moisture, humidity and the like.

During the installation of various building structural members such as trusses, joists and the like, it has been found to be beneficial to provide a protective member on the lower or outer end portion of such members, particularly at the location where the structural member rests on a support member such as a tie beam or cement block. Such a protective member provides protection against damage due to crushing of the structural member and also protection against moisture, humidity and other factors which can cause deterioration of the structural member.

Previous protective members for such trusses and joists have included configurations such as a flat plate member having a plurality of teeth struck therefrom, which plate is set in place on the bottom surface of a wooden truss member, for example, with teeth projecting upwardly, and then struck with a hammer to embed the teeth in the bottom surface of the truss. During construction of a building, the truss member with plate member attached is then rested upon a support member, with the plate member providing a protective interface between the truss and support member. The use of such a flat plate member has been accompanied by various problems, however, including the necessity for lifting a truss member which may already be in position on the support member, so as to provide access to the bottom of the truss and installation of the flat plate thereon.

SUMMARY OF THE INVENTION

By the present invention, there is provided an improved protective seat plate for use with trusses, joists and other wooden structural members for the purpose of protecting the outer or lower end portions of the structural member and thus preventing crushing of the wood at the end of such structural members while also providing protection against the deleterious effects of moisture and the like.

The seat plate of the present invention includes a pair of mutually perpendicular planar members which, in one embodiment, may be in the form of a flat sheet metal plate which is bent to provide first and second planar plate portions lying in respective first and second planes intersecting one another at substantially right angles. In this embodiment, the plate portions are bent about a fold line extending generally parallel to the line of intersection of the planes. One of the plate portions has a dimension in a direction perpendicular to the fold line which is substantially greater than the dimension of the other plate portion in a direction perpendicular to the fold line.

The smaller of the two plate portions has a plurality of teeth struck therein so as to provide a means of embedding the seat plate member in the wooden portions of the truss, joist or similar member.

The seat plate of the present invention is so disposed that, during installation, the larger plate portion is positioned in a generally horizontal location at the lower end of the truss or joist, and the smaller plate portion having teeth therein is located in a generally vertical position along a vertical side wall of the truss or joist. In order to install the seat plate of the invention, the seat plate is placed with the smaller, vertical plate portion adjacent a truss, for example, with the larger, horizontal plate portion disposed immediately below so as to be parallel to and contiguous with a lower surface of the truss. The vertical plate portion is then struck with a hammer so that the teeth are embedded in a side wall portion of the truss. Thus the seat plate member is advantageously installed by pressing the smaller, vertical plate portion against one side wall of the truss or joist. As the teeth are embedded in the side wall, the vertical plate portion will be positioned parallel to and contiguous with the vertical side wall of the truss.

A substantial advantage has been found to result from the use of the seat plate of the present invention in which no teeth are present in the flat or horizontal surface of the seat plate. If teeth were to be struck from the horizontal plate portion so as to extend outwardly from the top surface thereof, it would be difficult if not impossible to install the seat plate from the side of the truss or joist. Similarly, a disadvantage would result from the teeth being extended from the bottom surface of the horizontal member, since it would be difficult to transport a truss or joist having the seat plate installed with teeth extending below, and also the teeth extending from the lower portion of the seat plate would pose a dangerous instrument in use.

Accordingly, it is an object of the present invention to provide a protective member for a truss or joist or other similar structural member.

It is another object of the invention to provide a protective seat plate member which may be installed from the side of a truss or joist so as to provide protection against crushing of the structural member as well as against problems connected with moisture, humidity and the like, It is a further object of the invention to provide a seat plate member having a pair of planar plate portions in a specified ratio of dimensions thereof, so as to provide maximum protection by the use of a relatively small amount of plate material.

It is a further object of the invention to provide a seat plate protective member for a truss or joist, with the seat plate having highly effective attachment means for attaching the seat plate to the truss or joist to be protected.

DESCRIPTION OF THE PREFERRED EMBODIMENTS

Figure 1:
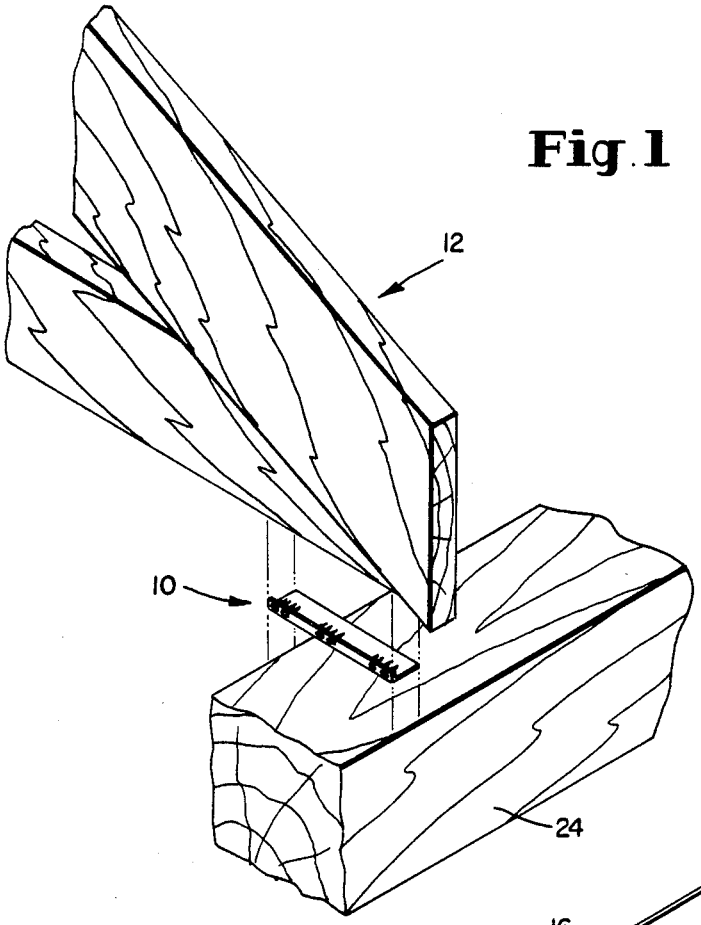
FIG. 1 is an exploded perspective view showing a seat plate member of the present invention to be installed upon a truss member.

In the embodiment of the invention as shown in FIGS. 1 through 4, there is provided a seat plate member 10 for installation upon a truss 12 in accordance with the present invention.

The seat plate 10 includes first 14 and second 16 planar plate portions obtained, for example, by bending a flat sheet metal plate about a fold line 18 so as to provide such planar plate portions 14, 16 lying in respective first and second planes intersecting each other and forming an included angle of approximately 90 degrees.

Plate portion 16 has a plurality of nail-like elongated teeth 20 struck to extend normal to plate portion 16 and on one side thereof. In the illustrated form, the teeth 20 are struck in longitudinally extending rows of successive pairs of teeth 20 which are spaced so that there are two pairs of teeth 20 followed by an interval and then by the next successive group of two pairs of teeth 20. The interval may be approximately equal to the distance along the plate portion 16 occupied by two pairs of teeth 20.

In extending substantially normal or perpendicular to the plate portion 16, the teeth 20 extend generally parallel to the other plate portion 14 and thus overlie this plate portion 14 as shown. The teeth 20 in the plate portion 16 may be struck by any conventional method such as that described in U.S. Pat. No. 4,343,580, commonly assigned, which is incorporated herein by reference. As the teeth are struck, a corresponding slot 22 will be formed between each successive pair of teeth 20. In the embodiment shown, the rows of teeth 20 as well as the rows of slots 22 extend generally along a line parallel to the fold line 18.

Figure 2:
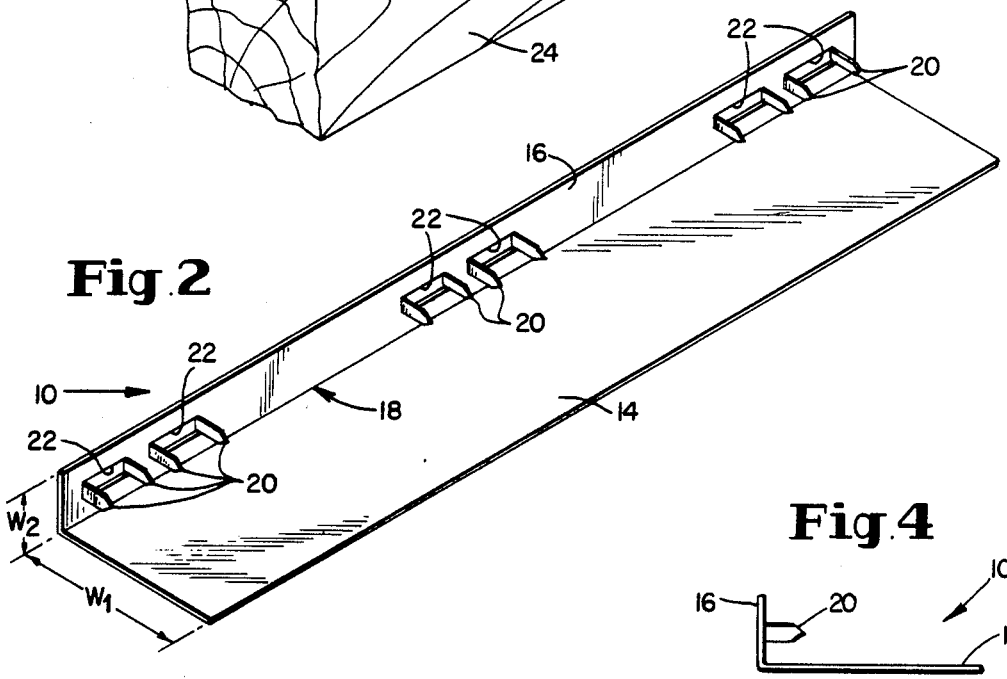
FIG. 2 is a perspective view of the seat plate member of the present invention.
Figure 4:
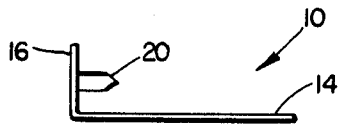
FIG. 4 is an end view of the seat plate member of FIG. 2.
Figure 3:
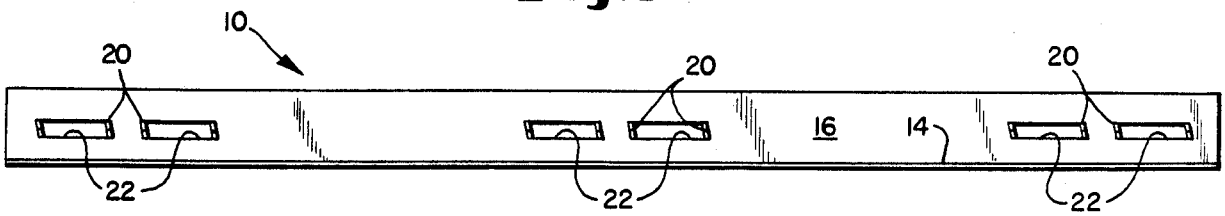
FIG. 3 is a front elevation of the seat plate member of FIG. 2.

As shown in FIG. 2, the first plate portion 14 has its width dimension $W_1$ in a direction perpendicular to the fold line 18 substantially greater than the corresponding width dimension $W_2$ of second plate portion 16. In one embodiment, the width $W_1$ of plate portion 14 was approximately 1½ inches and the width $W_2$ of plate portion 16 was approximately 5/16 inch. In this embodiment, the length of the plate 10 was about 8 inches so that both plate portions 14, 16 were in the general shape of a rectangle and the length of the teeth 20 was about ¼ inch.

In the arrangement as shown in FIG. 1, for example, the seat plate 10 would be installed by positioning the second or smaller plate portion 16 so as to abut a vertical side wall of the truss 12 and with the first or larger plate portion 14 abutting a horizontal lower surface of the truss 12. Once the plate 10 is in position with the teeth 20 pressing against the vertical side wall, the teeth may be embedded in said side wall by striking the plate portion 16 with a hammer.

When the seat plate 10 has been installed, the truss 12 may be positioned on a support member 24 such as a tie beam or cement block in order to function as a load bearing member. Due to the particular configuration of the seat plate 10 of the invention, it is also feasible to install the seat plate 10 while the truss 12 is resting on the support member 24. In so proceeding, the lower portion 14 of the seat plate 10 will be effectively wedged between the truss 12 and the support member 24 by the use of a hammer on the vertical plate portion 16, with the teeth 20 also being embedded in the truss 12 by such action.

While the seat plate 10 of the present invention is advantageously installed on the vertical side wall and horizontal lower surface of a structural member as previously discussed, it should be understood that the seat plate 10 may also be utilized on other surfaces of a structural member, such as an outwardly and upwardly extending surface, thereby to provide protection against structural damage, moisture and the like. The seat plate 10 provides such protection along the two planar surfaces of the structural member 12 which are covered by the seat plate 10, as well as along the edge surface which defines the intersection between the two planar surfaces.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of protecting a wooden structural member such as a truss, joist or the like against structural damage as well as damage due to moisture and humidity which comprises: attaching to a wooden structural member having at least one vertical side wall portion and at least one horizontal lower surface a seat plate in the form of a flat sheet metal plate bent about a fold line to form an L-shaped member in cross-section having first and second planar plate portions lying in respective first and second planes intersecting one another and forming an included angle of approximately 90 degrees; said first plate portion having its width dimension in a direction perpendicular to said fold line substantially greater than the corresponding width dimension of said second plate portion; said second plate portion having a plurality of elongated nail-like teeth struck therefrom so as to project to one side thereof for embedment into the structural member and leaving a plurality of elongated slots in said second plate portion, said teeth overlying said first plate portion and extending outwardly from said second plate portion in a direction generally perpendicular to said second plate portion, said seat plate being attached to said structural member so that the second plate portion abuts said vertical side wall portion of the structural member with the teeth thereof penetrating said structural member and with the first plate portion abutting said horizontal lower surface of the structural member.

2. The method of claim 1, including the further step of resting said wooden structural member on a support member with the first plate portion of said seat plate being disposed between the horizontal lower surface of said structural member and said support member.

3. The method of claim 1 wherein said wooden structural member is initially rested on a support member and wherein said seat plate is then attached on one side wall of said wooden structural member so that said first plate portion is wedged between said wooden structural member and said support member.

4. A reinforced and protected wooden structural member comprising: a wooden structural member having at least one vertical side wall portion and at least one horizontal lower surface, said structural member having attached thereto a seat plate in the form of a flat sheet metal plate bent about a fold line to form an L-shaped member in cross-section having first and second planar plate portions lying in respective first and second planes intersecting one another and forming an included angle of approximately 90 degrees, said first plate portion having its width dimension in a direction perpendicular to said fold line substantially greater than the corresponding width dimensions of said second plate portion;

said second plate portion having a plurality of elongated nail-like teeth struck therefrom so as to project to one side thereof for embedment into the structural member and leaving a plurality of elongated slots in said second plate portion, said teeth overlying said first plate portion and extending outwardly from said second plate portion in a direction generally perpendicular to said second plate portion, said seat plate being attached to said structural member so that the second plate portion abuts said vertical side wall portion of the structural member with the teeth thereof penetrating said structural member and with the first plate portion abutting said horizontal lower surface of the structural member.

5. The reinforced and protected wooden structural member of claim 4 wherein the second planar plate portion is substantially parallel to and contiguous with said vertical side wall of the wooden structural member.

6. The reinforced and protected wooden structural member of claim 4 wherein the first planar plate portion is substantially parallel to and contiguous with said horizontal lower surface of the wooden structural member.

* * * * *